US007621306B2

(12) United States Patent
Settles

(10) Patent No.: US 7,621,306 B2
(45) Date of Patent: Nov. 24, 2009

(54) LAUNDRY MACHINE DOOR WINDOW COVER

(76) Inventor: Jeremiah Marcus Settles, 3478 Frances Ave., Forreston, IL (US) 61030

( * ) Notice: Subject to any disclaimer, the term of this patent is extended or adjusted under 35 U.S.C. 154(b) by 603 days.

(21) Appl. No.: 11/388,123

(22) Filed: Mar. 23, 2006

(65) Prior Publication Data

US 2006/0213911 A1 Sep. 28, 2006

Related U.S. Application Data

(60) Provisional application No. 60/665,511, filed on Mar. 25, 2005.

(51) Int. Cl.
*B65D 65/02* (2006.01)

(52) U.S. Cl. ..... 150/165; 68/196; 150/154

(58) Field of Classification Search ..... 150/154, 150/165, 157; 68/13 R, 196
See application file for complete search history.

(56) References Cited

U.S. PATENT DOCUMENTS 3,279,515 A * 10/1966 Kesh ..... 108/90
5,117,807 A * 6/1992 Graulich ..... 126/190
5,353,781 A * 10/1994 Calvillo ..... 126/39 M
5,497,819 A * 3/1996 Chiang ..... 150/166
5,908,681 A * 6/1999 Foster ..... 428/99
6,457,334 B1 * 10/2002 Harker et al. ..... 68/3 R
D480,253 S * 10/2003 Raines ..... D6/617

* cited by examiner

*Primary Examiner*—Tri M Mai
(74) *Attorney, Agent, or Firm*—Raymond M. Galasso; David O. Simmons; Galasso & Associates, L.P.

(57) ABSTRACT

A laundry machine door window cover comprises a window cover body, a contiguous length of resilient material, a plurality of magnets and indicia. The window cover body has a central portion and a perimeter portion attached to central portion. The central portion is made from material that is non-transparent. The contiguous length of resilient material is secured lengthwise to the perimeter portion of the window cover body. The magnets are secured in spaced-apart relationship on the perimeter portion of the window cover body. The indicia provided on at least one side of the central portion of the window cover body.

3 Claims, 1 Drawing Sheet

LAUNDRY MACHINE DOOR WINDOW COVER

CROSS REFERENCE TO RELATED APPLICATIONS

This patent application claims priority to U.S. Provisional Patent Application having Ser. No. 60/665,511 filed Mar. 25, 2005 entitled "Launderer", having a common applicant herewith and being incorporated herein in its entirety by reference.

FIELD OF THE DISCLOSURE

The disclosures made herein relate generally to laundry washing and drying machines and, more particularly, to accessory items configured for being attached to a door of laundry washing and/or drying machines.

BACKGROUND

It is well known that clothes must be washed from time to time. To this end, a washing machine is generally used for washing clothes and a dryer is generally used for drying clothes. A washer and a dryer are both referred to herein as a laundry machine. Similarly, washing and/or drying clothes are examples of laundering clothes.

In many situations, not everyone has the convenience of having a washer and/or dryer in their living quarters (e.g., home, apartment, condo, etc). In such situations, a person may launder their clothes in a communal laundry room in an apartment complex, condominium complex, dormitory, etc. In other such situations, a person may launder their clothes at a clothes-washing facility commonly known as a laundromat, which is a business that provides access to laundry machines for a fee on a per-load basis.

Unfortunately, communal laundry rooms and laundromats are known as being locations where clothes are stolen or otherwise tampered with. As most commercial laundry machines have a window in the door thereof, a person can see another person's laundry, as it is being washed or dried. The ability to see a person's clothes through the window of a laundry machine allows desirable types and/or brands of clothes to be readily observed by others. Unscrupulous persons have been known to identify a load of clothes of another person that includes desirable types and/or brands of clothes and stealing such clothes, if the opportunity to do so presents itself. For example, a college student may leave the laundry room to tend to other obligations while their clothes are washing. During such time, another person may steal all or a portion of their clothes while they are being laundered in a laundry machine or after they have been laundered while they sit in the laundry machine after they have finished being laundered.

Therefore; an apparatus configured for preventing a person from seeing a load of clothes through a laundry machine door window would be advantageous, desirable and useful.

SUMMARY OF THE DISCLOSURE

The present invention relates to an article configured for precluding a load of clothes in a laundry machine from being readily viewed through a door window of the laundry machine. Embodiments of a laundry machine door window cover in accordance with the present invention are configured for being attached to a laundry machine door over the door window such that the laundry machine door window cover limits visibility through the door window. Accordingly, a laundry machine door window cover in accordance with the present invention serves to reduce the potential for tampering with and/or stealing clothes from within a laundry machine.

In one embodiment of the present. invention, a laundry machine door window cover comprises a window cover body, and a securing structure. The window cover body has a non-transparent central portion and a perimeter portion at least partially encompassing the non-transparent central portion. The securing structure is engaged with the perimeter portion of the window cover body. The securing structure includes at least one of a length of resilient material and a plurality of magnets.

In another embodiment of the present invention, a laundry machine door window cover comprises a window cover body, a securing structure and indicia. The window cover body has a central portion and a perimeter portion fully encompassing the central portion. The central portion is made from material that is non-transparent. The securing structure is engaged with the perimeter portion of the window cover body. The securing structure includes at least one of a length of resilient material and a plurality of magnets. The indicia are provided on at least one side of the central portion of the window cover body.

In another embodiment of the present invention, a laundry machine door window cover comprises a window cover body, a contiguous length of resilient material, a plurality of magnets and indicia. The window cover body has a central portion and a perimeter portion attached to central portion. The central portion is made from material that is non-transparent. The contiguous length of resilient material is secured lengthwise to the perimeter portion of the Window cover body. The magnets are secured in spaced-apart relationship on the perimeter portion of the window cover body. The indicia provided on at least one side of the central portion of the window cover body.

Turning now to specific aspects of the present invention, in at least. one embodiment, the securing structure includes the length of resilient material secured lengthwise to the perimeter portion of the window cover body and the magnets each secured in spaced-apart relationship on the perimeter portion of the window cover body.

In at least one embodiment of the present invention, the perimeter portion defines an opening encompassed by an interior edge of the perimeter portion, a doorframe receiving pocket is provided between the non-transparent central portion of the window cover body and the interior edge of the perimeter portion of the window cover body, the length of resilient material is positioned immediately adjacent the interior edge of the perimeter portion, and the magnets are positioned between the length of resilient material and the non-transparent central portion of the window cover body.

In at least one embodiment of the present invention, the length of resilient material is a contiguous length of resilient material extending essentially along an entire length of the interior edge of the perimeter portion.

In at least one embodiment of the present invention, the interior edge of the perimeter portion includes a sewn-in passage, the contiguous length of resilient material is located within the sewn-in passage and the magnets are each secured in spaced-apart relationship to an exterior surface of the perimeter portion of the window cover body adjacent the sewn-in passage.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
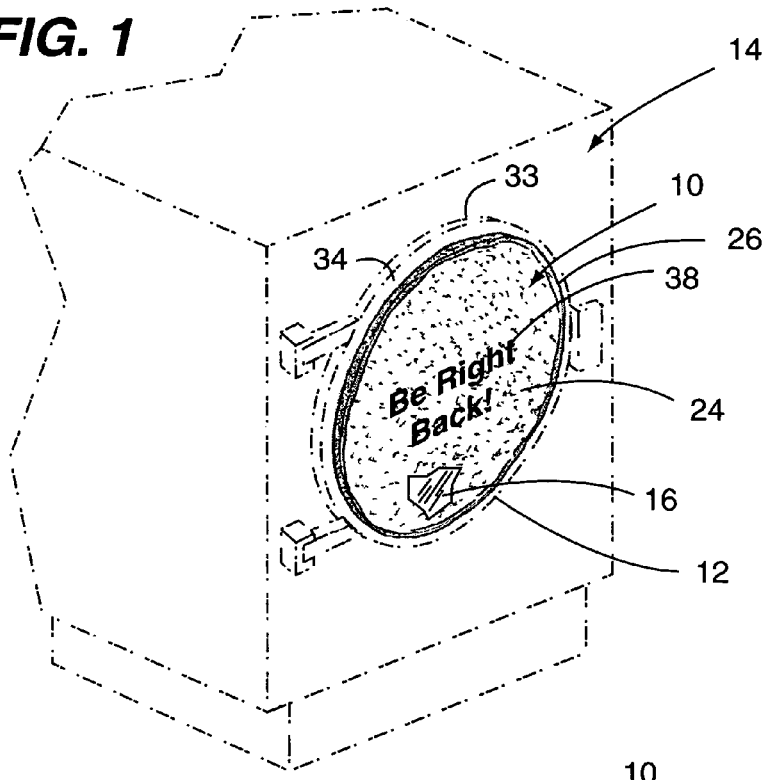
FIG. 1 is a partially fragmented perspective view showing an embodiment of a laundry machine door window cover in accordance with the present invention as installed on a door of a prior art laundry machine.

FIG. 1 depicts an embodiment of a laundry machine door window cover in accordance with the present invention, which is referred to herein as the laundry machine door window cover 10. The laundry machine door window cover 10 is mountable on a door 12 of a laundry machine 14. The laundry machine door window cover 10 precludes a load of clothes in the laundry machine 14 from being readily viewed through a door window 16 of the laundry machinel4. More specifically, the laundry machine door window cover 10 is configured for being attached to the laundry machine door 12 over the door window 16 such that the laundry machine door window cover 10 limits visibility through the door window 16. Accordingly, the laundry machine door window cover 10 serves to reduce the potential for tampering with and/or stealing clothes from within the laundry machine 14.

Figure 2:
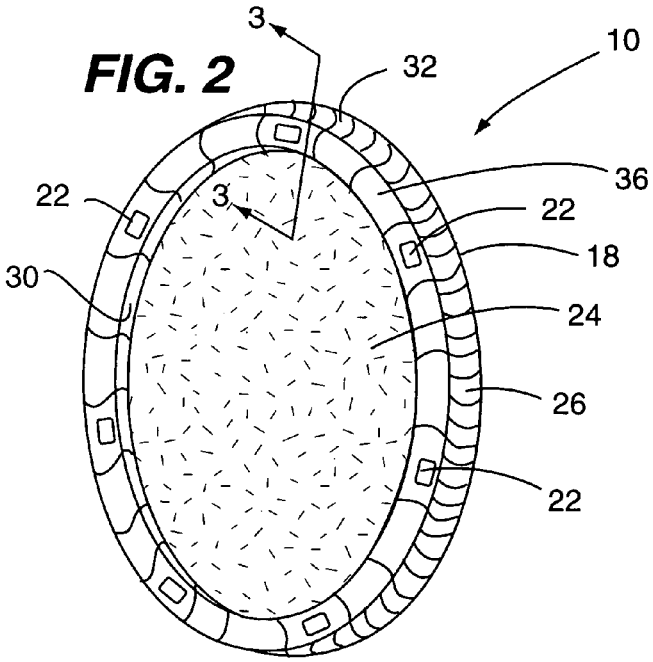
FIG. 2 is a perspective view showing a rear portion of the laundry machine door window cover shown in FIG. 1.
Figure 3:
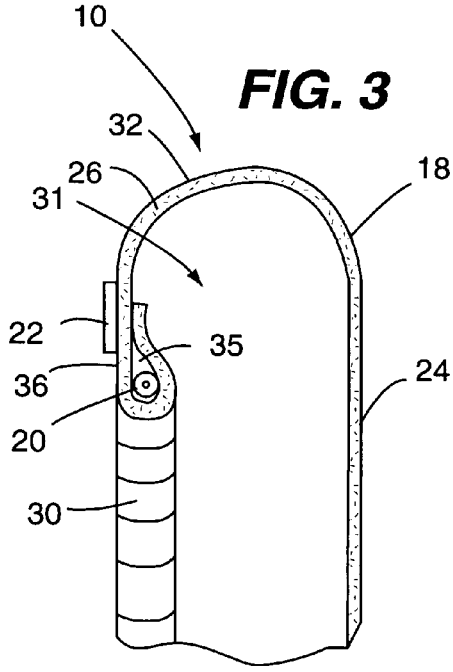
FIG. 3 is a cross-sectional view taken along the line 3-3 in FIG. 2.

Referring now to FIGS. 1-3, the laundry machine door window cover 10 includes a window cover body 18, a length of resilient material 20 (e.g., elastic stretch material) and a plurality of magnets 22. The window cover body 18 has a central portion 24 and a perimeter portion 26 attached to central portion 24. The central portion 24 is made from material that is non-transparent. Examples of known terms that represent non-transparent include translucent and opaque. Functionally, material that is non-transparent is defined herein to be material that cannot be seen through clearly, cannot be seen through fully, cannot be seen through without distortion and/or cannot be seen through at all. In general, a material that is referred to herein as being non-transparent will limit visibility through a door window of a laundry machine when placed in front of the door window.

The perimeter portion 26 defines an opening 28 encompassed by an interior edge 30 of the perimeter portion 26. A doorframe-receiving pocket 31 (FIG. 3) is provided between the central portion 24 of the window cover body 18 and the interior edge 30 of the perimeter portion 26 of the window cover body 18. In one embodiment, as depicted in FIG. 3, the length of resilient material 20 is positioned immediately adjacent the interior edge 30 of the perimeter portion 26 and the magnets 22 are positioned between the length of resilient material 20 and a perimeter edge 32 (FIGS. 2 and 3) of the central portion 26 of the window cover body 18. Alternatively, the plurality of magnets are positioned immediately adjacent the interior edge 30 of the perimeter portion 26 and the length of resilient material 20 is positioned between the plurality of magnets 22 and the perimeter edge 32 (FIGS. 2 and 3) of the central portion 26 of the window cover body 18.

The length of resilient material 20 enables the laundry machine door window cover 10 to be fitted over an outer edge 33 of the laundry machine door 12 and/or over an edge of a door window trim bezel (not specifically shown) of the laundry machine door 12. The magnets 22 enable the laundry machine door window cover 10 to be magnetically attached to a front surface 34 of the laundry machine door 12. Accordingly, the combined use of the length of resilient material 20 and the magnets 22 enhance versatility of the laundry machine door window cover 10 by allowing it to be attached to laundry machine doors of various sizes, shapes, designs and materials.

In a specific embodiment, as depicted in FIGS. 2 and 3, the interior edge 30 of the perimeter portion 26 includes a sewn-in passage 35. The length of resilient material 20 is located within the sewn-in passage 35, the magnets 22 are each secured in spaced-apart relationship to an exterior surface 36 of the perimeter portion 26 of the window cover body 18 adjacent the sewn-in passage 35 and the length of resilient material extends generally and contiguously lengthwise with respect to the perimeter portion 26 of the window cover body 18. It is disclosed herein, that in other embodiments, a contiguous length of resilient material or a plurality of discrete lengths of resilient material may be sewn onto or otherwise attached directly to material the perimeter portion 26, as opposed to being within the sewn-in passage 35. It is also disclosed herein, that in other embodiments, the laundry machine door window cover 10 includes a plurality of discrete lengths of resilient material that each extends generally lengthwise with respect to the perimeter portion 26 of the window cover body 18.

Preferably, but not necessarily, indicia 38 are provided on at least one side of the central portion of the window cover body. In one embodiment, the indicia 38 are provided directly on the material from which the central portion 24 of the laundry machine door window cover 10 is made. In another embodiment, the indicia are provided on a panel of material that is removably attachable to the central portion 24 of the laundry machine door window cover 10. An advantage of the panel configuration is that a plurality of different panels, each with different indicia, may be selectively attached to the central portion 24 of the laundry machine door window cover 10.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A laundry machine door window cover, comprising:

a window cover body having a non-transparent central portion and a perimeter portion attached to the central portion, wherein:

the perimeter portion defines an opening encompassed by an interior edge of the perimeter portion;

the interior edge of the perimeter portion includes a sewn-in passage; and a doorframe-receiving pocket is provided between the non-transparent central portion of the window cover body and the interior edge of the perimeter portion of the window cover body; and a securing structure engaged with the perimeter portion of the window cover body, wherein the securing structure includes:

a length of resilient material and a plurality of magnets;

the length of resilient material secured lengthwise to the perimeter portion of the window cover body, wherein:

the length of resilient material is positioned immediately adjacent the interior edge of the perimeter portion; and the length of resilient material is a contiguous length of resilient material extending essentially along an entire length of the interior edge of the perimeter portion, wherein the contiguous length of resilient material is located within the sewn-in passage; and the magnets each secured in spaced-apart relationship on the perimeter portion of the window cover body, wherein:

said magnets are positioned between the length of resilient material and the non-transparent central portion of the window cover body; and said magnets are each secured in spaced-apart relationship to an exterior surface of the perimeter portion of the window cover body adjacent the sewn-in passage.

2. A laundry machine door window cover, comprising:

a window cover body having a central portion and a perimeter portion fully encompassing the central portion, wherein:

the central portion is made from material that is non-transparent;

the perimeter portion defines an opening encompassed by an interior edge of the perimeter portion;

the interior edge of the perimeter portion includes a sewn-in passage; and a doorframe-receiving pocket is provided between the non-transparent central portion of the window cover body and the interior edge of the perimeter portion of the window cover body; and a securing structure engaged with the perimeter portion of the window cover body, wherein the securing structure includes:

a length of resilient material and a plurality of magnets;

the length of resilient material secured lengthwise to the perimeter portion of the window cover body, wherein:

the length of resilient material is positioned immediately adjacent the interior edge of the perimeter portion; and the length of resilient material is a contiguous length of resilient material extending essentially along an entire length of the interior edge of the perimeter portion, wherein the contiguous length of resilient material is located within the sewn-in passage; and the magnets each secured in spaced-apart relationship on the perimeter portion of the window cover body, wherein:

said magnets are positioned between the length of resilient material and the non-transparent central portion of the window cover body; and said magnets are each secured in spaced-apart relationship to an exterior surface of the perimeter portion of the window cover body adjacent the sewn-in passage; and indicia provided on at least one side of the central portion of the window cover body.

3. A laundry machine door window cover, comprising:

a window cover body having a central portion and a perimeter portion attached to the central portion, wherein:

the central portion is made from material that is non-transparent;

the perimeter portion defines an opening encompassed by an interior edge of the perimeter portion;

the interior edge of the perimeter portion includes a sewn-in passage; and a doorframe-receiving pocket is provided between the non-transparent central portion of the window cover body and the interior edge of the perimeter portion of the window cover body; and a contiguous length of resilient material secured lengthwise to the perimeter portion of the window cover body, wherein:

the contiguous length of resilient material is positioned immediately adjacent the interior edge of the perimeter portion; and the contiguous length of resilient material is located within the sewn-in passage; and a plurality of magnets each secured in spaced-apart relationship on the perimeter portion of the window cover body, wherein:

said magnets are positioned between the length of resilient material and the non-transparent central portion of the window cover body;

said magnets are positioned between the contiguous length of resilient material and the non-transparent central portion of the window cover body; and said magnets are each secured in-spaced-apart relationship to an exterior surface of the perimeter portion of the window cover body adjacent the sewn-in passage; and indicia provided on at least one side of the central portion of the window cover body.

* * * * *